US010762807B2

(12) United States Patent
Wang et al.

(10) Patent No.: US 10,762,807 B2
(45) Date of Patent: Sep. 1, 2020

(54) CIRCUMFERENTIAL LASER DYNAMIC DISPLAY DEVICE

(71) Applicants: Beijing Central Press Union Technology Co., Ltd., Beijing (CN); Sen Cong, Beijing (CN)

(72) Inventors: Hao Wang, Beijing (CN); Sen Cong, Beijing (CN); Pingping Ma, Beijing (CN); Zhigang Suo, Beijing (CN)

(73) Assignees: BEIJING CENTRAL PRESS UNION TECHNOLOGY CO., LTD., Beijing (CN); Sen Cong, Beijing (CN)

( * ) Notice: Subject to any disclaimer, the term of this patent is extended or adjusted under 35 U.S.C. 154(b) by 0 days.

(21) Appl. No.: 16/017,724

(22) Filed: Jun. 25, 2018

(65) Prior Publication Data

US 2019/0156713 A1 May 23, 2019

(30) Foreign Application Priority Data

Nov. 22, 2017 (CN) ..... 2017 2 1569409 U

(51) Int. Cl.
*G09F 19/12* (2006.01)
*G09F 11/06* (2006.01)
*G09F 19/02* (2006.01)

(52) U.S. Cl.
CPC ..... *G09F 19/12* (2013.01); *G09F 11/06* (2013.01); *G09F 19/02* (2013.01)

(58) Field of Classification Search
None
See application file for complete search history.

(56) References Cited

U.S. PATENT DOCUMENTS 4,342,992 A * 8/1982 Bozzini ..... G09F 11/10 340/815.82

* cited by examiner

*Primary Examiner* — Sharon E Payne
(74) *Attorney, Agent, or Firm* — Sinorica, LLC

(57) ABSTRACT

The invention discloses a circumferential laser dynamic display device, including an inner frame, having an inner frame pattern with multiframe microstructures made on surface; a sheet metal part, at least provided with first and second through holes, wherein the inner frame pattern is directly irradiated by a first beam of laser through the first through hole and by a second beam of laser through the second through hole; and a rotating shaft, with one end fixedly connected with a driving shaft, and the other end rotatably connected with the inner frame pattern. The rotating shaft can drive the inner frame pattern to do translational movement when rotating; wherein the translational movement of the inner frame enables the inner frame pattern to do circumferential movement relative to laser. The dynamic display device disclosed by the invention has simple structure, reasonable design and low production cost, and achieves circumferential dynamic image display.

6 Claims, 10 Drawing Sheets

CIRCUMFERENTIAL LASER DYNAMIC DISPLAY DEVICE

TECHNICAL FIELD

The present invention relates to a dynamic display device, in particular to a circumferential laser dynamic display device.

BACKGROUND

As is well known, a laser lamp is mainly composed of three parts including a laser light source, a mechanical movement mechanism and a diffractive optical element, wherein micro/nano-scale microstructures are processed on the surface of the diffractive optical element. The diffractive optical element can be used for outputting incident dot laser as a required image by utilizing a diffractive effect of the micro/nano-scale structures on light. Due to the characteristics of high brightness and high collimation of the laser, the laser lamp can achieve long-distance and high-brightness image display, thereby having been rapidly developed on European and American markets and the domestic market in recent years.

Although laser lamps have been used for over 10 years, at present, most of laser lamp products on the market can only display static images. In order to enrich the representation content and improve the representation effect, the laser lamp is required to achieve dynamic display of an image, namely arbitrary image transformation, image translation and image rotation. The problem urgent to be solved in the industry is to achieve an ideal dynamic display effect of the laser lamp serving as a mass consumer product on the premise that the cost and the system complexity are not increased obviously. In order to achieve a good dynamic image display effect, overall optimization is required on the aspects of the optical design of the diffractive optical element, an arrangement way of each frame of images and a mechanical movement structure. At present, static images or combinations of static images without internal relations thereamong serve as mainstream laser lamp products, and a small number of products can achieve certain dynamic image display, however, the effect is unideal.

The existing solution for achieving a dynamic effect on the laser lamp mainly includes: each frame of patterns is arranged in a sector to form a ring, and the whole ring-shaped diffractive optical element do circumferential movement around the center of a circle. The solution has the advantages of simple and reliable structure and low cost, however, each frame of images can rotate around a rotation center in a display process to result in image swing to affect the display effect.

In order to achieve the dynamic image display of the laser lamp, it is required to take the three factors into comprehensive consideration: (1) the design for the optical structure of the diffractive optical element: in order to achieve dynamic display of images, a certain amount of microstructures are required to be made on the surface of the same diffractive optical element, and each of the different microstructures corresponds to a frame of images. In order to achieve translation and rotation effects of the images, design means such as central symmetry and off-axis are required to be comprehensively used on the optical design aspect of the diffractive optical element; (2) the design for geometric parameters of the diffractive optical element: in order to achieve the dynamic display of the images, a series of microstructures are required to be made on the surface of the diffractive optical element, and geometric parameters such as size of single microstructure, the relative position of the adjacent microstructure and the arrangement way of the microstructures directly affect the dynamic image display effect. The parameters are required to be determined by taking the response characteristic of human eyes or a detector and the movement characteristic of a mechanical movement structure of a diffractive optical device into comprehensive consideration; and (3) the design for the mechanical movement structure of the diffractive optical device: a relative translational movement is required between a laser beam and the diffractive optical device in order to achieve the dynamic display of the images. The smooth transition among different frames of images can be achieved only by matching the movement with the geometric design parameters of the diffractive optical device.

The information disclosed in the background is merely intended to strengthen the understanding of the overall background of the present invention, but should not be regarded as an admission or any-form suggestion that the information constitutes the prior art well known by the ordinary skilled in the art.

SUMMARY

The present invention aims at providing a circumferential laser dynamic display device to overcome the defects of complex structure, high cost and single representation form of the existing technical solution.

In order to achieve the above purpose, the present invention provides a circumferential laser dynamic display device including an inner frame, a sheet metal part and a rotating shaft, wherein an inner frame pattern with multiframe microstructures is made on the surface of the inner frame; the sheet metal part is at least provided with a first through hole and a second through hole, wherein the inner frame pattern is directly irradiated by first laser through the first through hole and is directly irradiated by second laser through the second through hole; one end of the rotating shaft is fixedly connected with a driving shaft, the other end of the rotating shaft is rotatably connected with the inner frame, and the rotating shaft can drive the inner frame to do translational movement when rotating; wherein due to the translational movement of the inner frame, the inner frame pattern is enabled to do circumferential movement relative to the laser.

Preferably, in the technical solution, the inner frame pattern includes a first inner frame pattern and a second inner frame pattern.

Preferably, in the technical solution, the dynamic display device further includes an outer frame retainer and a middle frame; the middle frame is arranged at the inner side of the outer frame retainer and can move left and right in the outer frame retainer, wherein the inner frame is arranged in the middle frame, and the middle frame can do up-and-down translational movement in the middle frame.

Preferably, in the technical solution, the rotating shaft drives the inner frame to do translational movement in the middle frame when rotating, and meanwhile, the rotating shaft drives the middle frame to do translational movement in the outer frame retainer through the inner frame.

Preferably, in the technical solution, the rotating shaft includes a first rotating shaft and a second rotating shaft, the first rotating shaft is connected with a first rotating handle, the second rotating shaft is connected with a second rotating handle, and the first rotating handle and the second rotating handle synchronously move to drive the first inner frame pattern and the second inner frame pattern to synchronously do translational movement.

Preferably, in the technical solution, the middle of the sheet metal part is provided with a first gear, the first rotating shaft is connected with the sheet metal part through a second gear, the second rotating shaft is connected with the sheet metal part through a third gear, the first gear is meshed with the second gear and the third gear, and the first rotating shaft and the second rotating shaft can synchronously do circumferential movement.

Compared with the prior art, the circumferential laser dynamic display device has the following beneficial effects:

A new arrangement way of each frame of images is designed by utilizing the dynamic display device provided by the present invention on the premises that no additional movement control units are provided and the volume and cost of the system are hardly increased, so that the dynamic image display of the laser lamp is achieved. The organic combination of the design for a diffractive optical element and the design for a mechanical movement structure is achieved by the overall consideration of both. By using the circumferential laser dynamic display device provided by the present invention, it is convenient for the laser lamp industry to achieve the technical upgrading under the condition that the cost is low as much as possible, and key technical problems generated in upgrading and replacement processes of the laser lamp industry are solved.

DESCRIPTION OF MAIN REFERENCE NUMBERS

Figure 1:
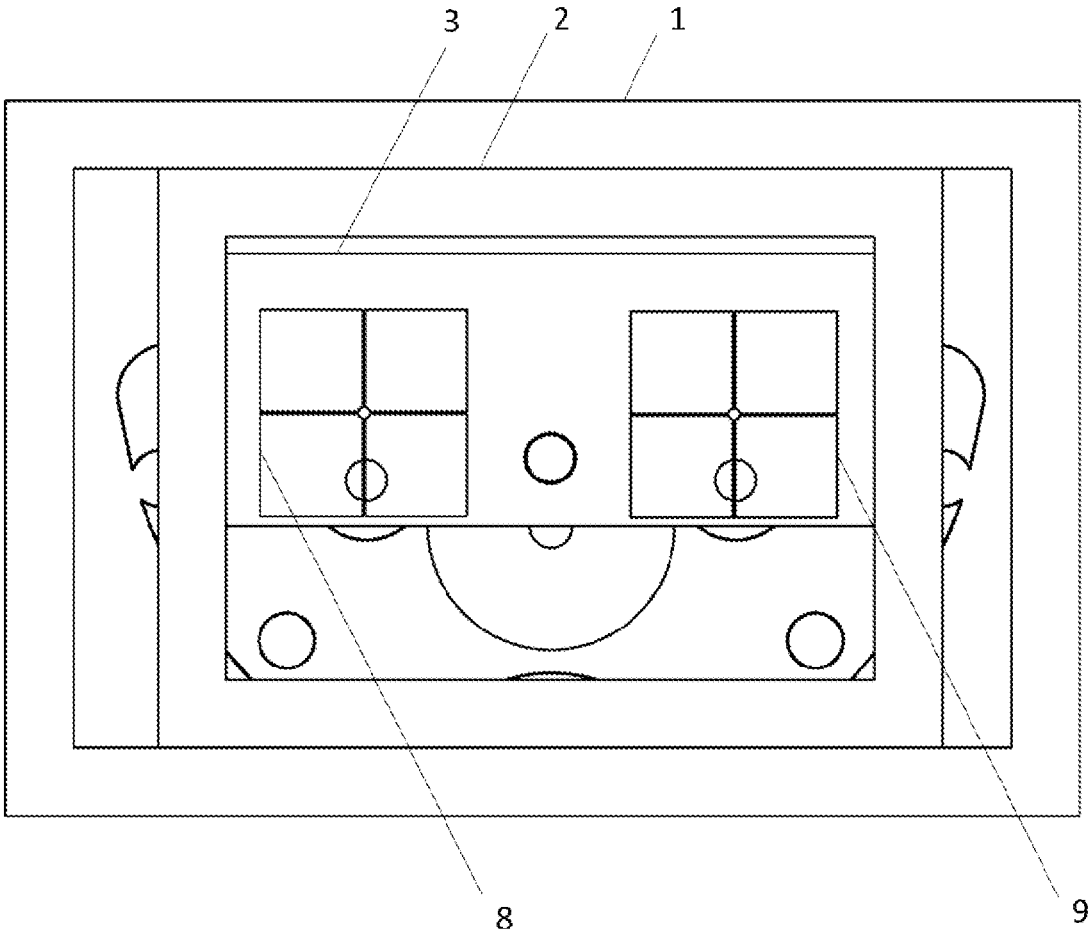
FIG. 1 is a front schematic view of a dynamic display device in an embodiment 1 of the present invention.
Figure 2:
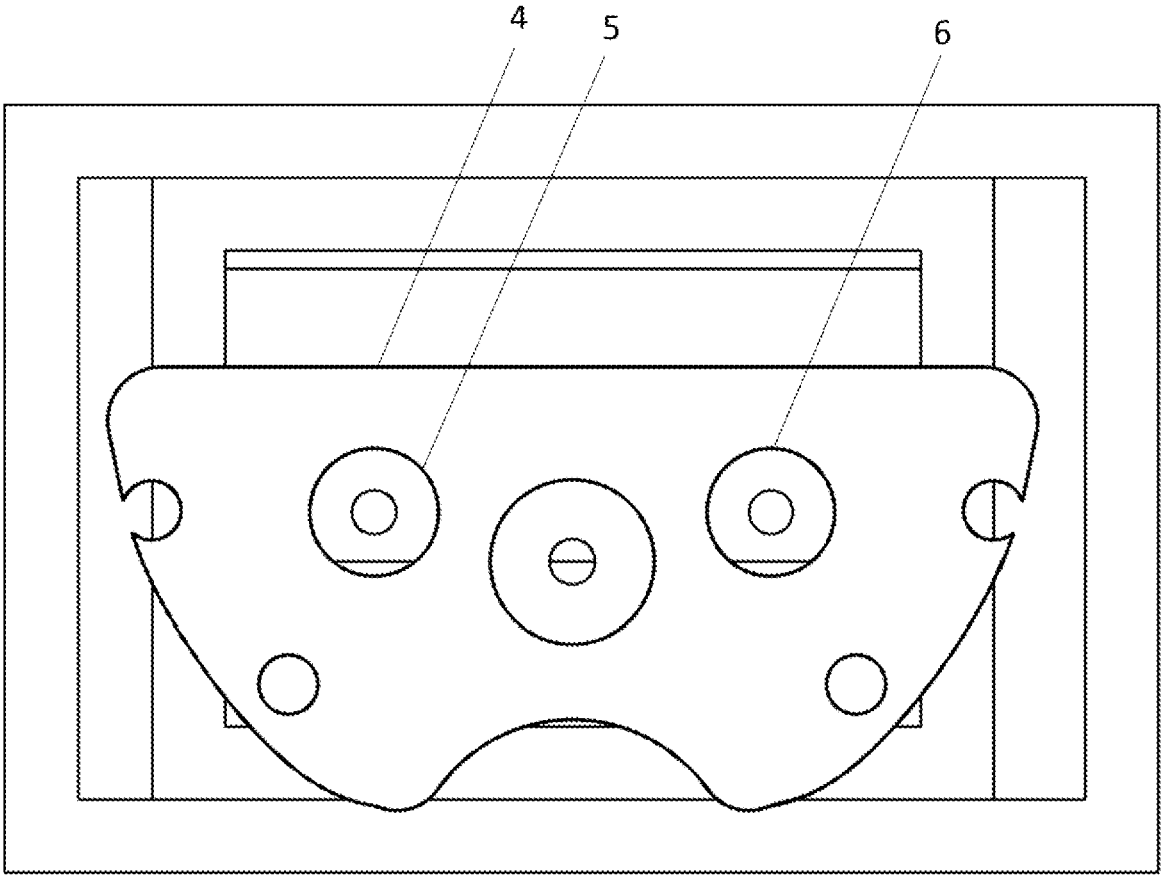
FIG. 2 is a rear schematic view of the dynamic display device in the embodiment 1 of the present invention.
Figure 3:
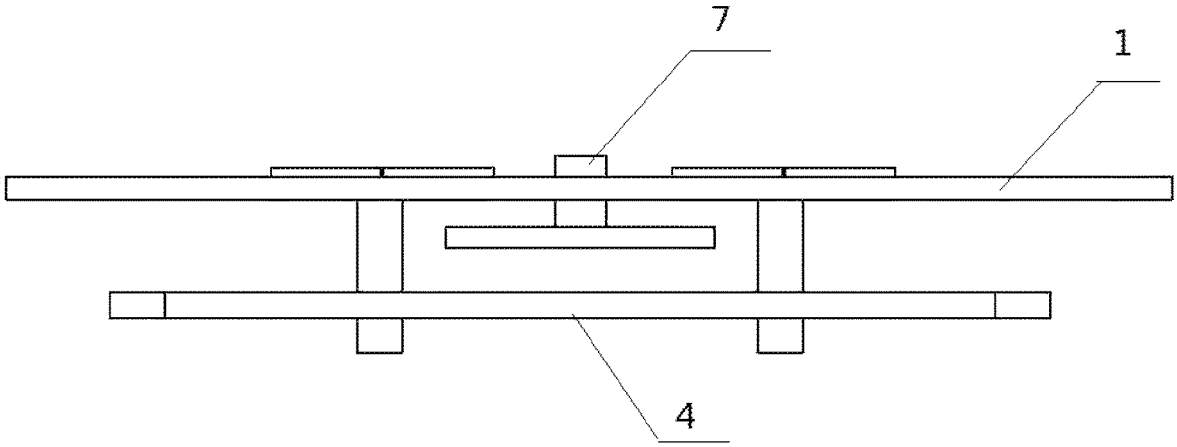
FIG. 3 is a top plan view of FIG. 2.
Figure 4:
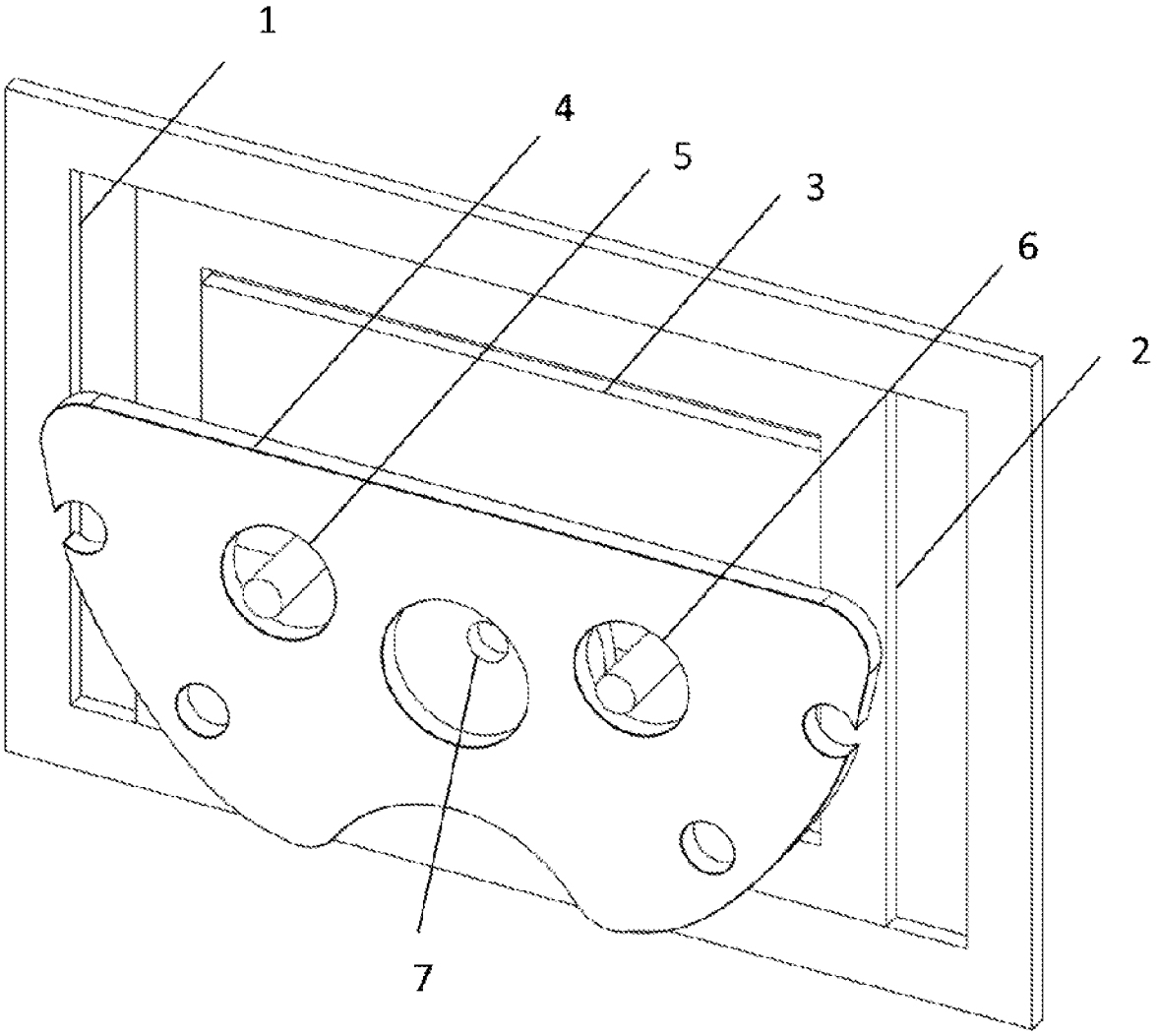
FIG. 4 is a perspective view of the dynamic display device in the embodiment 1 of the present invention.
Figure 5:
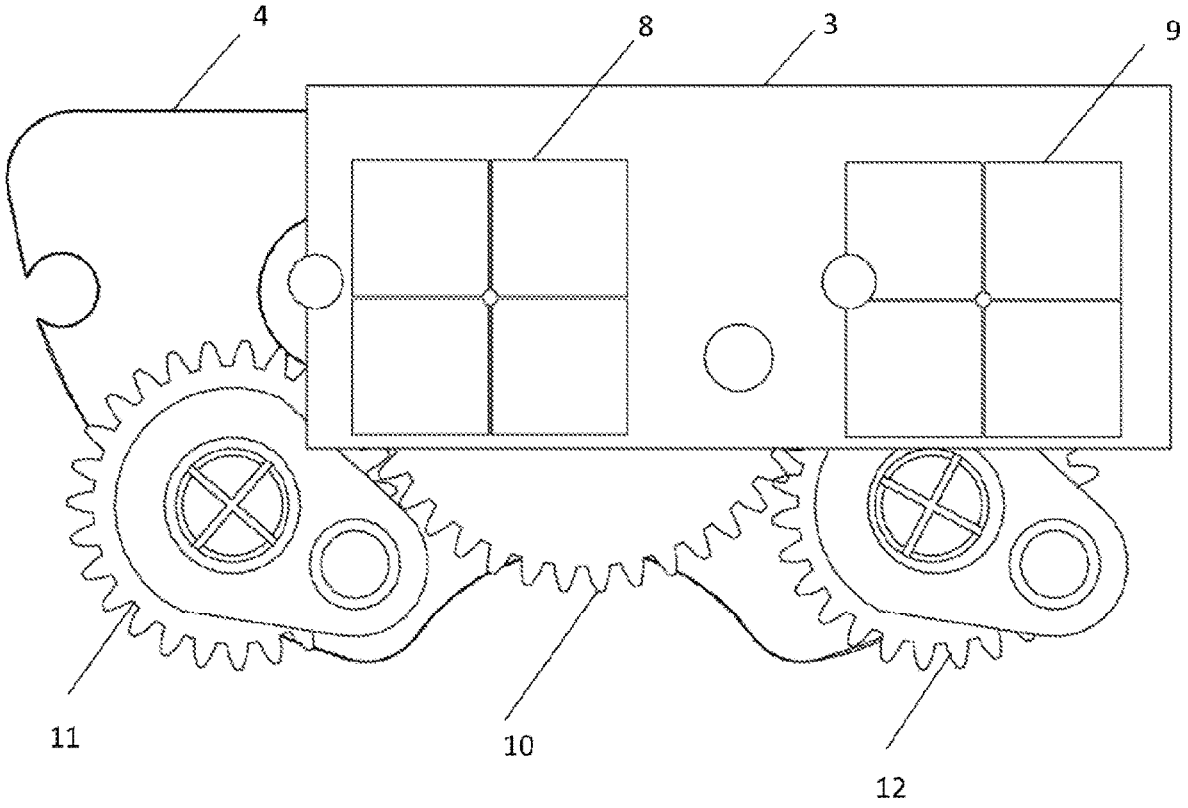
FIG. 5 is a front schematic view of the dynamic display device in an embodiment 3 of the present invention.
Figure 6:
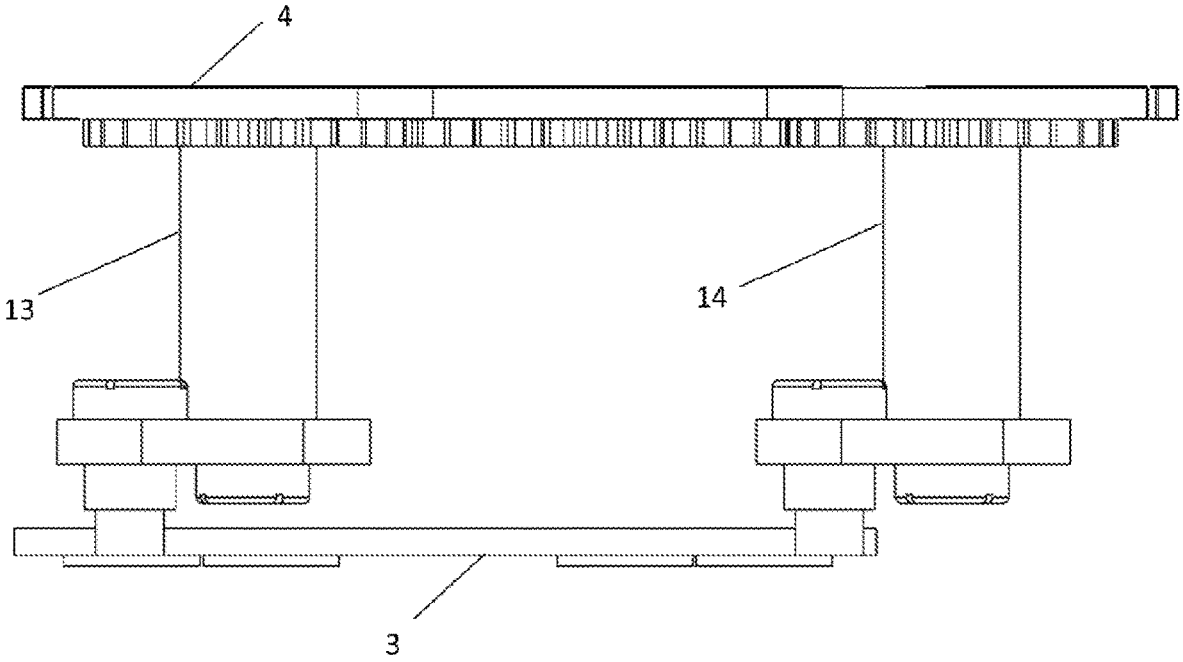
FIG. 6 is a top plan view of FIG. 5.

1—outer frame retainer, 2—middle frame, 3—inner frame, 4—sheet metal part, 5—first through hole, 6—second through hole, 7—rotating shaft, 8—first inner frame pattern, 9—second inner frame pattern, 10—first gear, 11—second gear, 12—third gear, 13—first rotating shaft, 14—second rotating shaft, and 15—limiting plate 15.

DETAILED DESCRIPTION

The implementation of the present invention is described in detail below in combination with the accompanying drawings, however, it should be understood that the scope of the present invention is not limited by the implementation.

Unless other contexts clearly dictate, the term "including" or a variation thereof such as "containing" or "comprising" in the whole description and claims will be understood as that the stated elements or components are included, but other elements or other components are not excluded.

Embodiment 1: as shown in FIG. 1 to FIG. 4, a circumferential laser dynamic display device according to an embodiment of the present invention includes an outer frame retainer 1, a middle frame 2, an inner frame 3, a sheet metal part 4 and a rotating shaft 7, wherein the sheet metal part 4 is at least provided with a first through hole 5 and a second through hole 6, wherein the inner frame pattern 3 is directly irradiated by first laser through the first through hole 5 and is directly irradiated by second laser through the second through hole 6. The first laser can be green light, the second laser can be red light, the inner frame pattern includes a first inner frame pattern 8 and a second inner frame pattern 9 which are directly irradiated by the red light and the green light respectively. One end of the rotating shaft 7 is fixedly connected with a driving shaft, and the other end of the rotating shaft 7 is rotatably connected with the inner frame 3. The middle frame 2 is arranged at the inner side of the outer frame retainer 1 and can move left and right in the outer frame retainer 1, wherein the inner frame 3 is arranged in the middle frame 2, and the middle frame 3 can do up-and-down translational movement in the middle frame 2. Due to the combination of up-and-down movement of the inner frame and the left-and-right movement of the middle frame, the inner frame pattern is enabled to do circumferential movement relative to the laser. The rotating shaft 7 can drive the inner frame pattern to do translational movement when rotating, and the positive direction of the inner frame pattern cannot be changed when the inner frame pattern does translational movement. When being in a static state, each frame of patterns of the inner frame pattern is arranged in a rectangle; During dynamic translation, each frame of patterns of the inner frame pattern does circumferential movement to form a circle, and the laser is enabled to sequentially scan the inner frame pattern in the circle according to the order of the circumferential movement to obtain the circular diffractive optical element, so that the dynamic display effect is achieved.

Embodiment 2: as shown in FIG. 4 to FIG. 8, a circumferential laser dynamic display device according to the other embodiment of the present invention includes an outer frame retainer 1, an inner frame 3, a sheet metal part 4, a rotating shaft 7 and a limiting plate 15, wherein the sheet metal part 4 is at least provided with a first through hole 5 and a second through hole 6, and an inner frame pattern is directly irradiated by first laser through the first through hole 5 and is directly irradiated by second laser through the second through hole 6; and one end of the rotating shaft 7 is fixedly connected with a driving shaft, and the other end of the rotating shaft 7 is riveted or hinged with the inner frame 3 to form rotatable connection.

Two ends of the limiting plate 15 are slidably assembled at the inner side of the outer frame retainer 1, the limiting plate 15 can move left and right in the outer frame retainer 1, and a sliding chute which is horizontally distributed and corresponds to the limiting plate 15 is formed in the inner wall of the outer frame retainer 1; a strip-shaped hole which is distributed up and down is formed in the middle of the limiting plate 15, and one side of the inner frame 3 downwards extends to form a hinged shaft correspondingly extending into the strip-shaped hole; due to the combination of up-and-down movement of the inner frame and the left-and-right movement of the middle frame, the inner frame pattern is enabled to do circumferential movement relative to the laser, the strip-shaped hole in the limiting plate 15 provides abdication and displacement limit for keeping the up-and-down movement of the inner frame 3 in a process that the inner frame rotates along with the rotating shaft (or an eccentric wheel), the limiting plate 15 is slidably assembled on the inner wall of the outer frame retainer and is used for providing displacement limit for the left-and-right movement of the inner frame 3, the rotating shaft 7 can drive the inner frame pattern to do translational movement when rotating, and during translational movement of the inner frame pattern, the positive direction of the inner frame pattern is kept unchanged when the inner frame 3 displaces.

Figure 7:
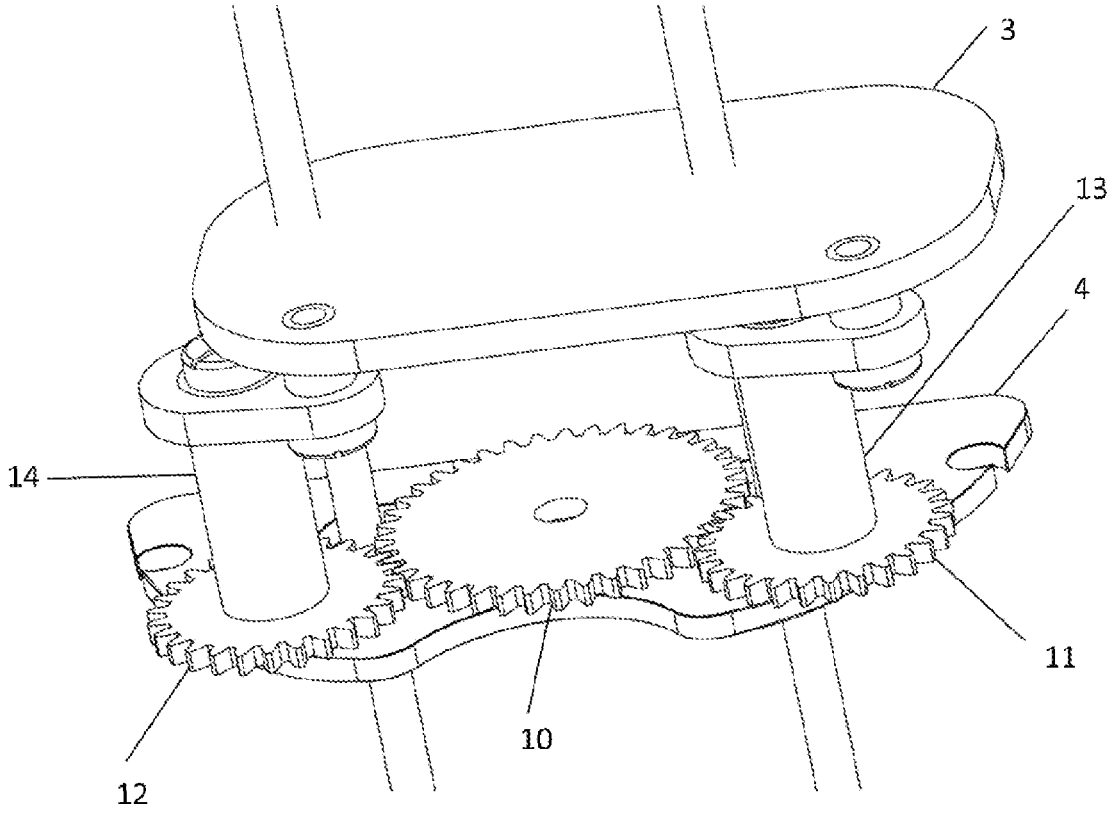
FIG. 7 is a schematic perspective view of the dynamic display device in the embodiment 3 of the present invention.
Figure 8:
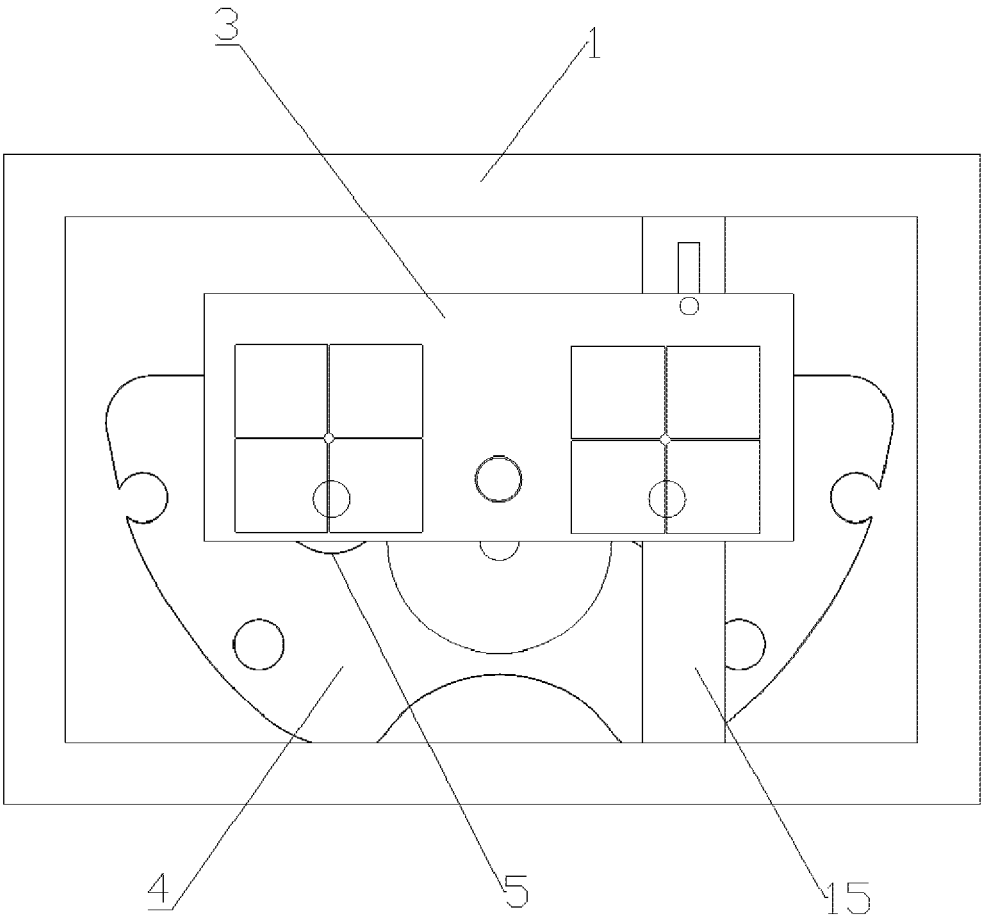
FIG. 8 is a front schematic view of the dynamic display device in an embodiment 2 of the present invention.

Embodiment 3: as shown in FIG. 7 to FIG. 7, a circumferential laser dynamic display device according to another embodiment of the present invention includes an inner frame 3, a sheet metal part 4, a rotating shaft and a gear set. The sheet metal part 4 is at least provided with a first through hole 5 and a second through hole 6, wherein an inner frame pattern is directly irradiated by first laser through the first through hole 5 and is directly irradiated by second laser through the second through hole 6. The inner frame pattern includes a first inner frame pattern 8 and a second inner frame pattern 9. The rotating shaft includes a first rotating shaft 13 and a second rotating shaft 14, the first rotating shaft 13 is connected with a first rotating handle, the second rotating shaft 14 is connected with a second rotating handle, and the first rotating handle and the second rotating handle synchronously move to drive the first inner frame pattern and the second inner frame pattern 9 to synchronously do translational movement. The middle of the sheet metal part 4 is provided with a first gear 10, the first rotating shaft 13 is connected with the sheet metal part 4 through a second gear 11, the second rotating shaft 14 is connected with the sheet metal part 4 through a third gear 12, the first gear 10 meshed with the second gear 11 and the third gear 12, the first rotating shaft 13 and the second rotating shaft 14 can synchronously do circumferential movement so as to be only allowed to do translational movement to ensure that each frame of patterns is upward, so that the dynamic display effect is achieved. When being in a static state, each frame of patterns of the inner frame pattern is arranged in a rectangle due to the translational circumferential movement of the inner frame pattern; and during dynamic translation, the inner frame pattern does circumferential movement to form a circle, and the laser is enabled to sequentially scan the inner frame pattern in the circle according to the order of the circumferential movement to obtain the circular diffractive optical element. In a display process of each frame, the diffractive optical element is only allowed to do translational movement to prevent the pattern from swinging.

Figure 9:
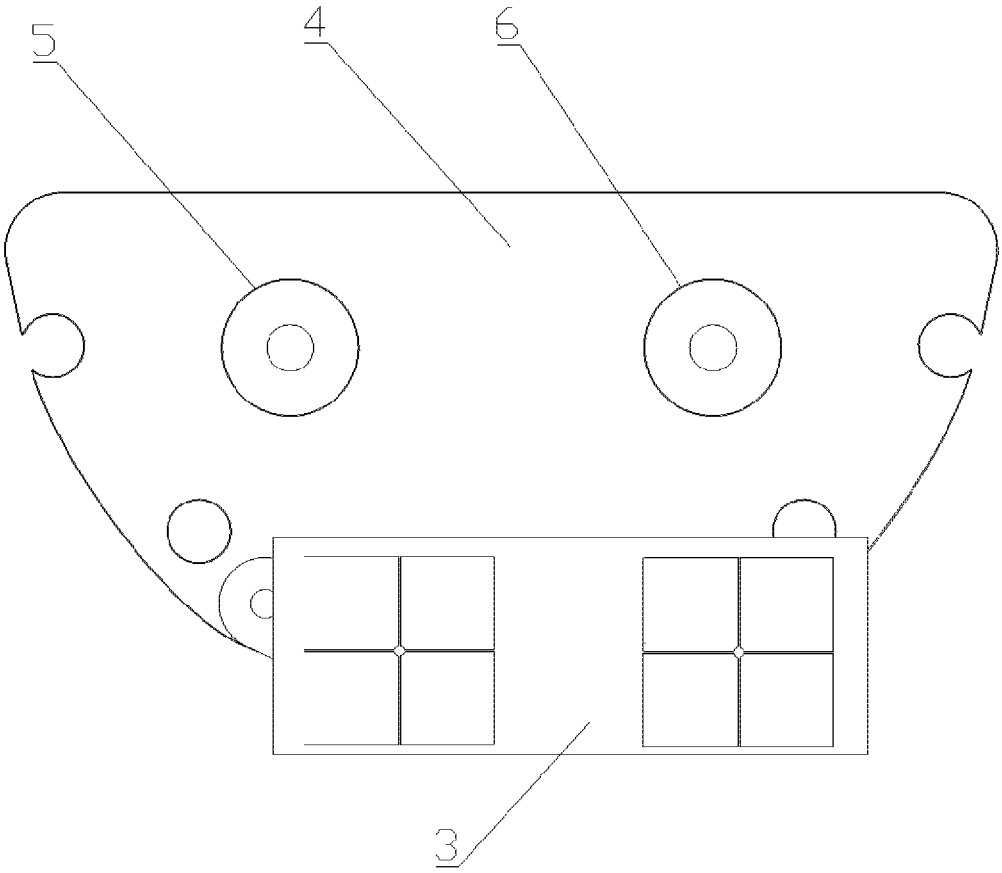
FIG. 9 is a front schematic view of the dynamic display device in an embodiment 4 of the present invention.
Figure 10:
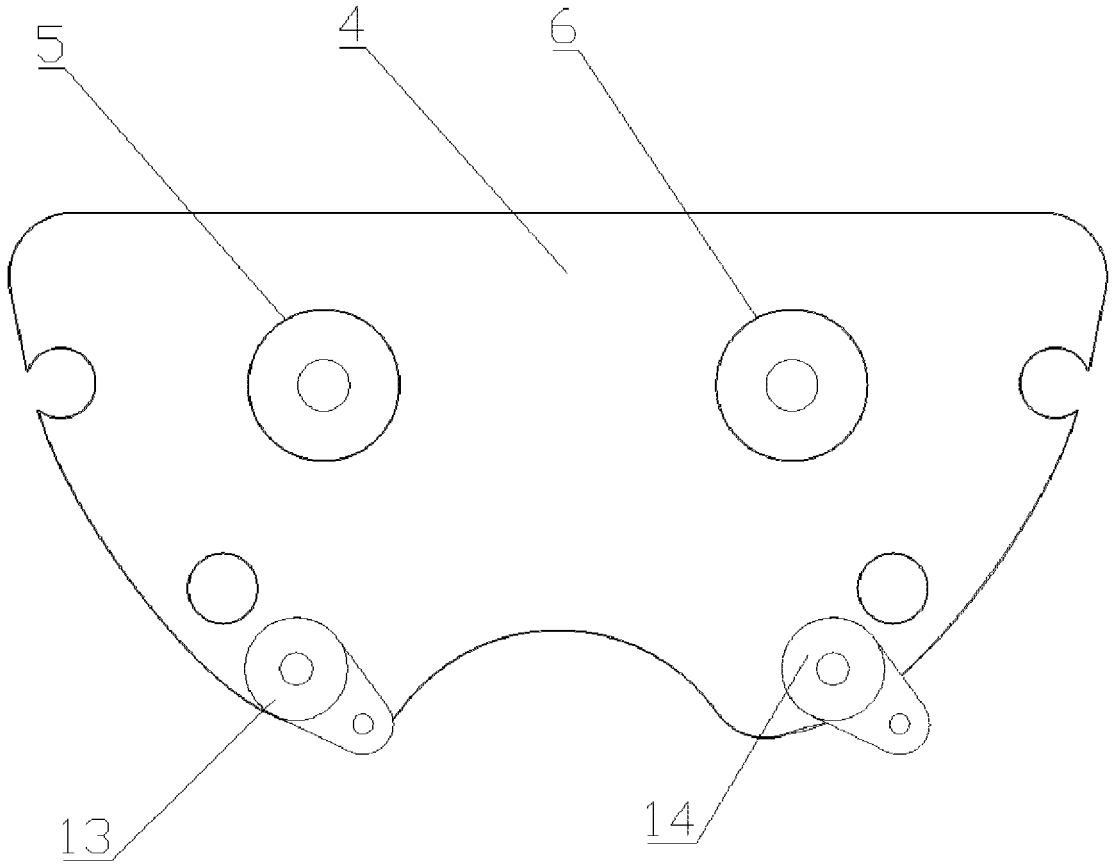
FIG. 10 is a structural schematic view of FIG. 9 in which an inner frame is removed.

Embodiment 4: as shown in FIG. 9 to FIG. 10, a circumferential laser dynamic display device according to the another embodiment of the present invention includes an inner frame 3, a sheet metal part 4 and a rotating shaft, wherein the sheet metal part 4 is at least provided with a first through hole 5 and a second through hole 6, and an inner frame pattern is directly irradiated by first laser through the first through hole 5 and is directly irradiated by second laser through the second through hole 6. The inner frame pattern includes a first inner frame pattern 8 and a second inner frame pattern 9.

The rotating shaft includes a first rotating shaft 13 and a second rotating shaft 14, the first rotating shaft 13 is connected with a first rotating handle, the second rotating shaft 14 is connected with a second rotating handle, the other end of the first rotating shaft 13 is fixedly connected with a driving shaft, and the other end of the first rotating handle or the second rotating handle is riveted or hinged with the inner frame 3 to form rotatable connection; and the driving shaft drives the first rotating shaft 13 to rotate, the first rotating handle and the second rotating handle rotate along with the first rotating shaft 13 to synchronously move with the inner frame 3 so as to drive the first inner frame pattern and the second inner frame pattern 9 to synchronously do translational movement.

One end of the second rotating shaft 14 is connected with the inner frame 3 by the second rotating handle, and the other end of the second rotating shaft 14 is hinged or riveted to the sheet metal part.

The first rotating shaft 13 and the second rotating shaft 14 can synchronously do circumferential movement so as to be only allowed to do translational movement to ensure that each frame of patterns are upward, so that the dynamic display effect is achieved. When being in a static state, each frame of patterns of the inner frame pattern is arranged in a rectangle due to the translational circumferential movement of the inner frame pattern; and during dynamic translation, the inner frame pattern does circumferential movement to form a circle, and the laser is enabled to sequentially scan the inner frame pattern in the circle according to the order of the circumferential movement to obtain the circular diffractive optical element. In a display process of each frame, the diffractive optical element is only allowed to do translational movement to prevent the pattern from swinging.

The specific exemplary embodiments of the present invention are described for descriptive and illustrative purposes. The description is not intended to limit the present invention as the disclosed precise form, and it is apparent that various changes and variations can be made according to the above teachings. The exemplary embodiments are selected and described in order to explain specific principles and practical applications thereof, and therefore, various different exemplary embodiments of the present invention as well as various different choices and changes can be implemented and utilized by the skilled in the art. The scope of the present invention is intended to be limited by the claims and equivalents thereof.

What is claimed is:

1. A circumferential laser dynamic display device, comprising:

an inner frame, an inner frame pattern with multiframe microstructures being made on a surface of the inner frame;

a sheet metal part, at least provided with a first through hole and a second through hole, wherein the inner frame pattern is directly irradiated by a first laser through the first through hole and is directly irradiated by a second laser through the second through hole; and a rotating shaft, one end of the rotating shaft being fixedly connected with a driving shaft, the other end of the rotating shaft being rotatably connected with the inner frame, and the rotating shaft being capable of driving the inner frame to do translational movement when rotating;

wherein due to the translational movement of the inner frame, the inner frame pattern is enabled to do circumferential movement relative to at least one of the first laser and the second laser.

2. The circumferential laser dynamic display device of claim 1, wherein the inner frame pattern comprises a first inner frame pattern and a second inner frame pattern.

3. The circumferential laser dynamic display device of claim 1, further comprising: an outer frame retainer and a middle frame, wherein the middle frame is arranged at an inner side of the outer frame retainer and can move left and right in the outer frame retainer, and the inner frame is arranged in the middle frame and can do up-and-down translational movement in the middle frame.

4. The circumferential laser dynamic display device of claim 3, wherein the rotating shaft drives the inner frame to do translational movement in the middle frame when rotating, and meanwhile, the rotating shaft drives the middle frame to do translational movement in the outer frame retainer through the inner frame.

5. The circumferential laser dynamic display device of claim 2, wherein the rotating shaft comprises a first rotating shaft and a second rotating shaft, the first rotating shaft is connected with a first rotating handle, the second rotating shaft is connected with a second rotating handle, and the first rotating handle and the second rotating handle synchronously move to drive the first inner frame pattern and the second inner frame pattern to synchronously do translational movement.

6. The circumferential laser dynamic display device of claim 5, wherein the middle of the sheet metal part is provided with a first gear, the first rotating shaft is connected with the sheet metal part through a second gear, the second rotating shaft is connected with the sheet metal part through a third gear, the first gear is meshed with the second gear and the third gear, and the first rotating shaft and the second rotating shaft can synchronously do circumferential movement.

* * * * *